US012728332B1

(12) United States Patent
Flynn

(10) Patent No.: US 12,728,332 B1
(45) Date of Patent: Sep. 8, 2026

(54) MODULAR PICKLEBALL PADDLE QUEUE SLIDING RACK

(71) Applicant: Brian William Flynn, Newport Coast, CA (US)

(72) Inventor: Brian William Flynn, Newport Coast, CA (US)

( * ) Notice: Subject to any disclaimer, the term of this patent is extended or adjusted under 35 U.S.C. 154(b) by 0 days.

(21) Appl. No.: 19/054,115

(22) Filed: Feb. 14, 2025

Related U.S. Application Data

(60) Provisional application No. 63/662,781, filed on Jun. 21, 2024.

(51) Int. Cl.
*A63B 60/56* (2015.01)
*A63B 102/08* (2015.01)

(52) U.S. Cl.
CPC ..... *A63B 60/56* (2015.10); *A63B 2102/08* (2015.10)

(58) Field of Classification Search
CPC ..... A47F 7/0028; A47F 5/0025; A47F 1/04; A63B 2102/08; A63B 2102/16; A63B 71/0036; A63B 71/0045; A63B 67/04; A63B 67/045; A63B 60/56; A63B 60/58; A63B 60/60
See application file for complete search history.

(56) References Cited

U.S. PATENT DOCUMENTS

D231,001 S * 3/1974 Gross et al. ..... D6/552
3,842,979 A * 10/1974 Doelcher ..... A63B 71/0045 211/14
3,858,725 A * 1/1975 Pietrack ..... A63B 71/0045 211/74
4,154,442 A * 5/1979 Trubody ..... A63B 60/58 211/85.7
4,286,717 A * 9/1981 Liesinger ..... B25H 3/04 211/89.01
4,643,317 A * 2/1987 Wilkinson ..... A63B 60/58 473/460
5,024,336 A * 6/1991 Spamer ..... F16B 12/10 211/153
5,050,756 A * 9/1991 Tielker ..... B25H 3/06 220/23.4
5,368,172 A * 11/1994 Barringer ..... A63B 47/00 211/85.7
5,632,386 A * 5/1997 Gabhart ..... A63B 47/00 D6/552

(Continued)

FOREIGN PATENT DOCUMENTS

CN 202762024 U * 3/2013
CN 211611568 U * 10/2020
DE 202004002558 U1 * 4/2004 ..... A47F 7/0028

OTHER PUBLICATIONS

DE 202004002558.*

*Primary Examiner* — Patrick D Hawn
(74) *Attorney, Agent, or Firm* — Plager Schack LLP; Mark H. Plager; Kara K. Verryt

(57) ABSTRACT

A sliding pickleball paddle queue rack for storing paddles and quickly and easily updating the queue may include an elongate rack with a channel extending into and along a greatest length thereof; and a plurality of paddle caddies slidably positioned within the channel, each paddle caddy of the plurality of paddle caddies configured to securely accommodate placement of a plurality of paddles therein, wherein the plurality of paddle caddies are designed to freely slide along a length of the channel.

10 Claims, 4 Drawing Sheets

(56) References Cited

U.S. PATENT DOCUMENTS

| | | | | |
|---|---|---|---|---|
| 6,523,702 | B1 * | 2/2003 | Primiano | A47F 1/12 211/183 |
| 6,571,966 | B1 * | 6/2003 | Hsiao | A47F 7/0028 206/379 |
| 6,779,670 | B2 * | 8/2004 | Primiano | A47F 1/12 211/74 |
| 6,920,986 | B2 * | 7/2005 | Lacombe | B25H 3/003 211/70.6 |
| 7,798,336 | B2 * | 9/2010 | Shiao | B25H 3/04 211/DIG. 1 |
| 8,157,677 | B1 * | 4/2012 | Chen | A63B 67/045 211/13.1 |
| 8,763,819 | B2 * | 7/2014 | Theisen | A47F 7/0028 211/119.003 |
| 9,248,362 | B2 * | 2/2016 | Durant | A63B 60/60 |
| 9,380,889 | B2 * | 7/2016 | Howard | A47F 7/28 |
| 10,463,173 | B2 * | 11/2019 | Robbins | A47F 1/126 |
| 10,926,152 | B2 * | 2/2021 | Tucker | A47F 5/0006 |
| 2005/0045641 | A1 * | 3/2005 | Doran | B44D 3/14 220/507 |
| 2014/0263119 | A1 * | 9/2014 | Gruger | A47F 7/0028 211/85.7 |
| 2020/0121106 | A1 * | 4/2020 | Tsao | A47G 23/0208 |
| 2024/0350889 | A1 * | 10/2024 | Garritano | A63B 71/0036 |
| 2025/0295968 | A1 * | 9/2025 | Dinan | A63B 60/58 |

* cited by examiner

MODULAR PICKLEBALL PADDLE QUEUE SLIDING RACK

RELATED APPLICATION

This application claims priority to provisional patent application U.S. Ser. No. 63/662,781 filed on Jun. 21, 2024, the entire contents of which is herein incorporated by reference.

BACKGROUND

The embodiments herein relate generally to athletic equipment and, more particularly, to a sliding paddle queue rack for sports utilizing paddles or rackets.

At pickleball courts, players queue to wait for a court. Conventionally, the queue is formed by paddles being placed in a static rack. When a court opens up, players must manually move the paddles up the line by hand, one at a time. This is not only inefficient, but also leads to confusion and conflict.

Therefore, what is needed is more efficient and less time-consuming queue rack for pickleball paddles, wherein the need to manually move each and every paddle is eliminated.

SUMMARY

Some embodiments of the present disclosure include a sliding pickleball paddle queue rack for storing paddles and quickly and easily updating the queue. The sliding pickleball paddle queue rack may include an elongate rack with a channel extending into and along a greatest length thereof; and a plurality of paddle caddies slidably positioned within the channel, each paddle caddy of the plurality of paddle caddies configured to securely accommodate placement of a plurality of paddles therein, wherein the plurality of paddle caddies are designed to freely slide along a length of the channel.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a sliding pickleball paddle queue rack and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-8, some embodiments of the present disclosure include a sliding pickleball paddle queue rack for storing paddles and quickly and easily updating the queue, the sliding pickleball paddle queue rack comprising an elongate rack with a channel extending into and along a greatest length thereof; and a plurality of paddle caddies slidably mounted within the channel, each paddle caddy of the plurality of paddle caddies configured to securely accommodate placement of paddles therein, wherein the plurality of paddle caddies are designed to freely slide along a length of the channel.

Figure 1:
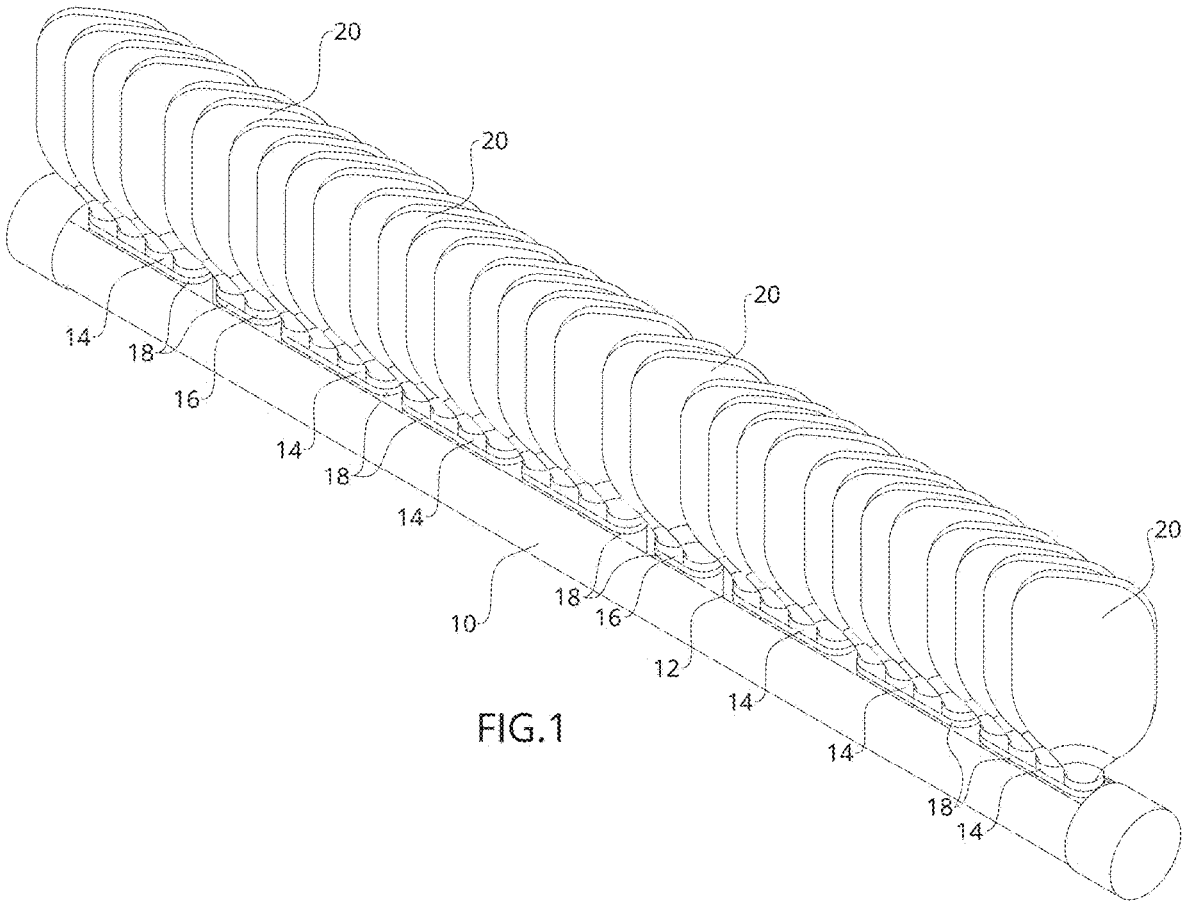
FIG. 1 is a perspective view of one embodiment of the present disclosure.

More specifically, and as shown in FIGS. 1-5, the sliding pickleball paddle queue rack of the present disclosure may comprise an elongate rack 10 comprising a first end, a second end, and a channel 12 extending into a top surface of the rack 10 and from the first end of the rack 10 to the second end of the rack 10. As shown, the rack 10 may be substantially cylindrical with caps closing off each end thereof. The channel 12 may be substantially rectangular and sized to accommodate placement of the paddle caddies therein. A bottom surface of the channel 12 may be substantially planar or flat to evenly support the paddle caddies. A depth of the channel 12 may be smaller than a height of the paddle caddies, such that the paddle caddies extend upward out of the channel 12 when placed therein, as shown in FIG. 1. As shown in FIGS. 1-5, the length of the elongate rack 10 may be fixed.

Figure 6:
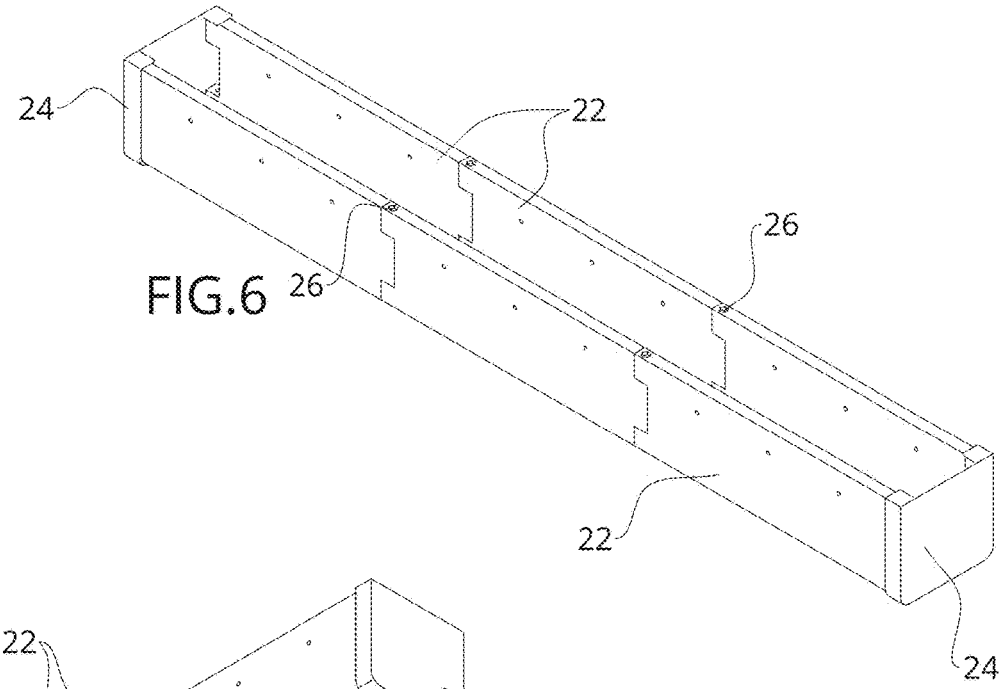
FIG. 6 is a perspective view of one embodiment of the present disclosure.
Figure 7:
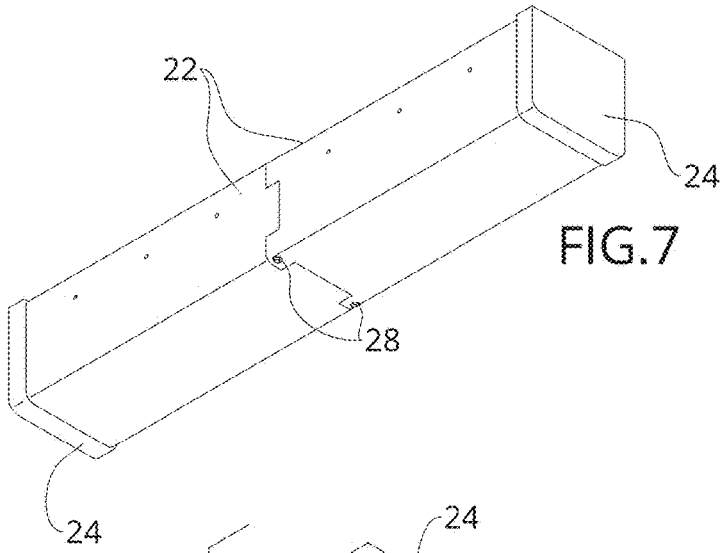
FIG. 7 is a bottom view of one embodiment of the present disclosure.
Figure 8:
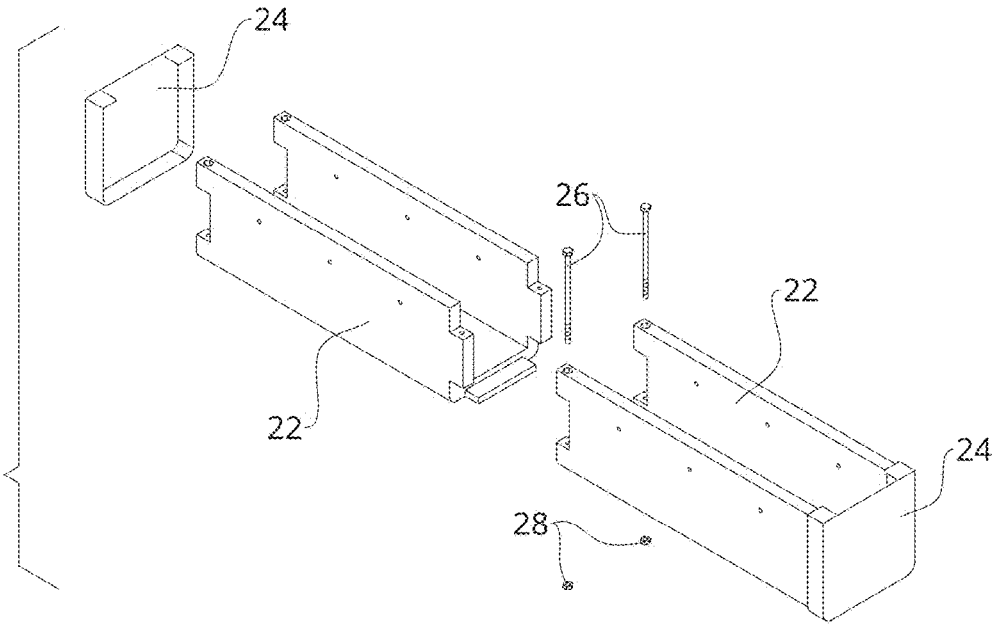
FIG. 8 is an exploded view of one embodiment of the present disclosure.

In an alternative embodiment, such as that shown in FIGS. 6-8, the elongate rack may have an adjustable length. In such embodiments, the elongate rack may comprise a plurality of rack sections 22 attached together until the desired length is achieved. In these embodiments, each rack section 22 may comprise a base and two sidewalls extending upward, such as substantially perpendicularly upwards, from opposite edges of the base, forming a U-shaped or squared off U-shaped section. A first end of each rack section 22 may have a center tab extending outward from the sidewalls, while a second end of each rack section may have a central notch cut therein, the central notch sized to accommodate insertion of a center tab from an adjacent caddy section 22 therein. A fastener, such as a bolt 26, may then be used to attach the two rack sections 22 together by extending through the sidewalls of the first section and a center tab of a second section. As shown in FIG. 8, each caddy section may have a bottom tab extending outward from the base at the first end thereof and a bottom notch extending into the base on a second end thereof, such that a bottom tab on a first section may be positioned to engage with a bottom notch on a second section. As such, embodiments of the rack may be modular with a customizable length. In such modular embodiments, the end caps 24 that engage with the ends of the elongate rack may also be squared off to engage with the ends of the distal sections.

While other variations of the rack are not shown, it is envisioned that the rack may be shaped elongate member with a channel extending therein, so long as the channel is sized toa accommodate slidable placement of the paddle caddies therein.

Figure 2:
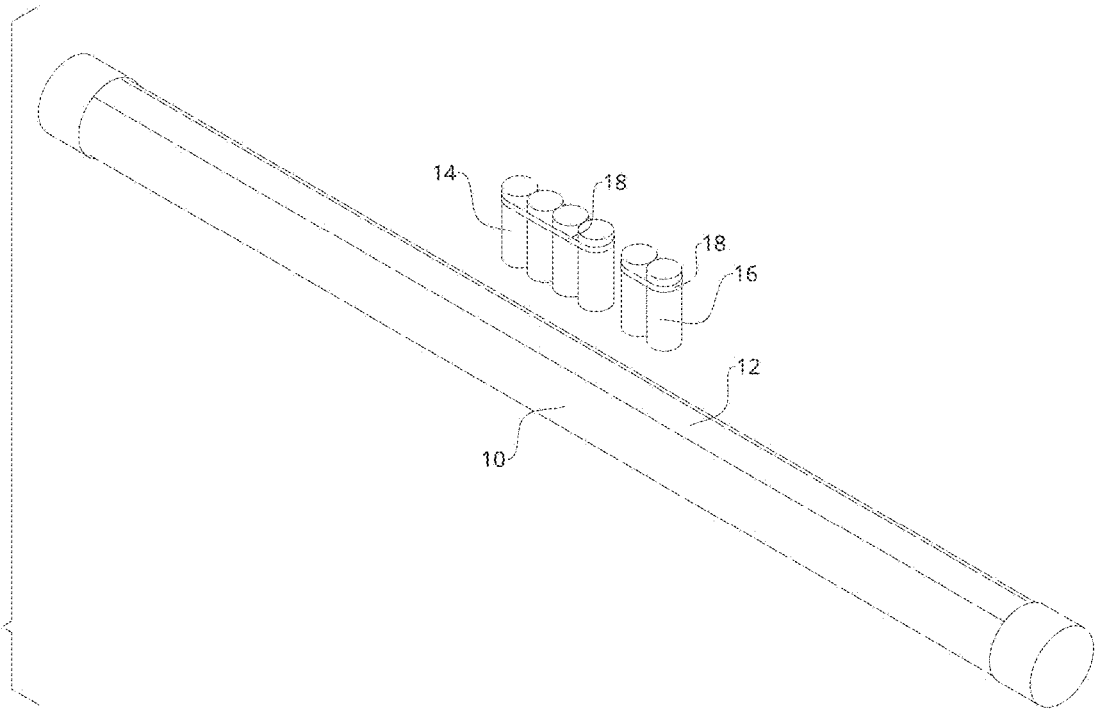
FIG. 2 is an exploded view of one embodiment of the present disclosure.
Figure 3:
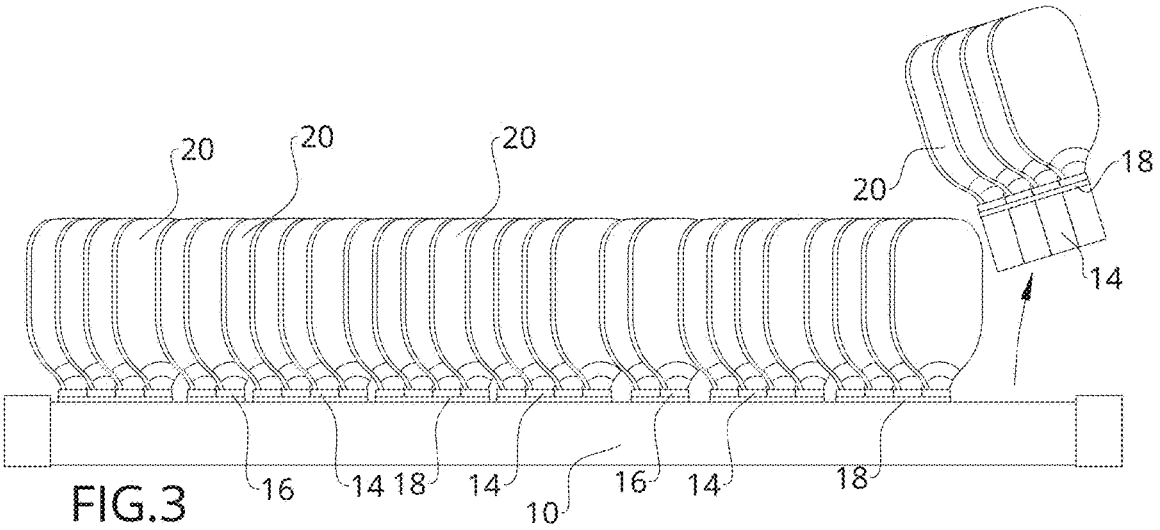
FIG. 3 is a front view of one embodiment of the present disclosure.
Figure 4:
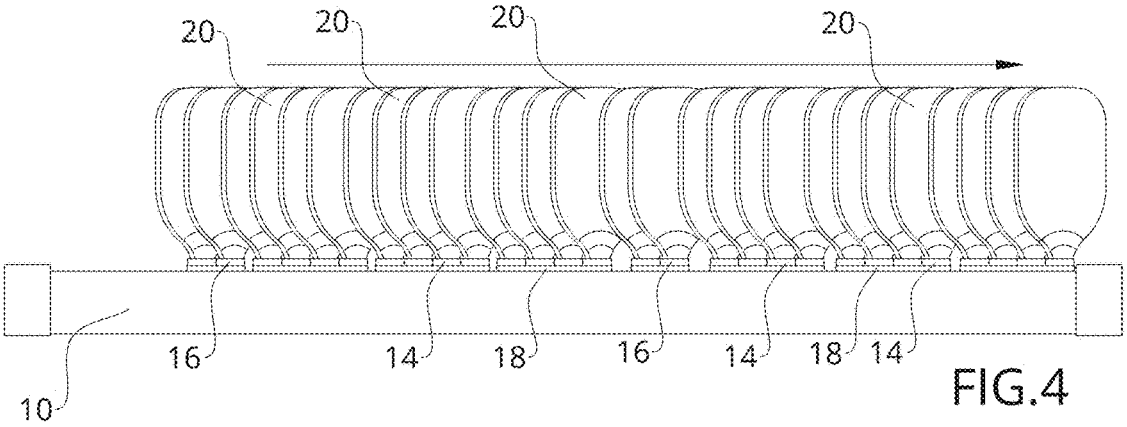
FIG. 4 is a front view of one embodiment of the present disclosure, showing the sliding feature.
Figure 5:
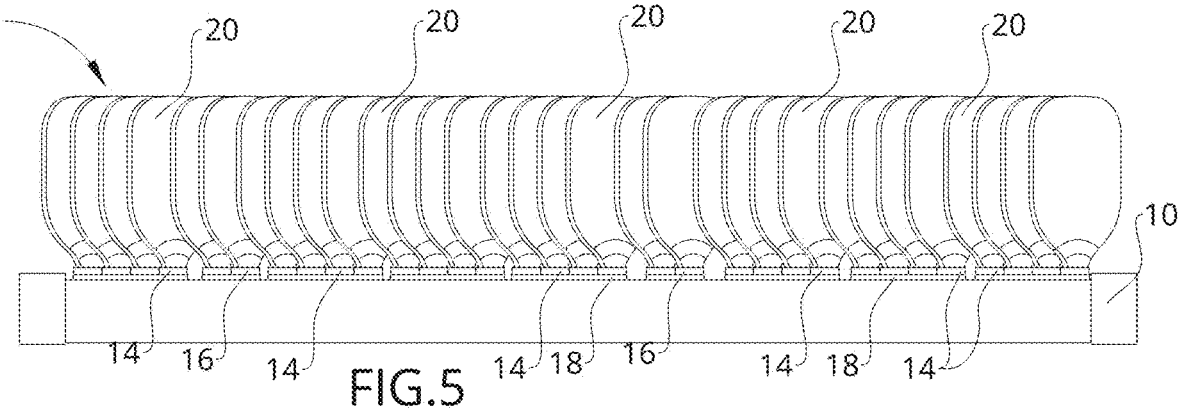
FIG. 5 is a front view of one embodiment of the present disclosure.

As mentioned above, a plurality of paddle caddies may be slidably placed into the channel. As shown most clearly in FIG. 2, the caddies may be designed to hold varying number of paddles. For example, a four-paddle caddy 14 may be designed to accommodate placement of four paddles 20 therein, while a two-paddle caddy 16 may be designed to accommodate placement of two paddles 20 therein. In any case, the paddle caddy may comprise a carriage with a first end, a second end, and an open top, thus defining a paddle storage area, wherein a number of paddles may be lined up within the carriage. Each carriage may comprise at least one partition, dividing the interior of the carriage into multiple paddle holders. In some embodiments, each paddle caddy may comprise a plurality of cylindrical members attached in a line, wherein each cylindrical member is hollow with a closed bottom and is sized to accommodate insertion of one paddle handle therein. As such, for a four-paddle caddy 14, the caddy may comprise four cylindrical members attached in a line, while for a two-paddle caddy 16, the caddy may comprise two cylindrical members attached to one another, as shown in FIG. 2. While four paddle caddies 14 and two paddle caddies 16 may be the most commonly used and desired sized caddies for pickleball players, it is envisioned that caddies may be designed to hold fewer or more paddles. In any case, the caddies may be sized to fit within the channel in the rack and to slide along a length of the channel.

While not required, in embodiments, each paddle caddy may preferably include a color strip 18 encircling a top section of the caddy. Each caddy may have a different colored strip. This color strip 18 may allow users to easily identify their grouping of paddles and quickly identify which group is next in line to play.

The sliding pickleball paddle queue rack of the present disclosure may be made of any suitable materials and may have any sufficient dimensions. As mentioned above, the length of the rack may vary and, in some embodiments, may be adjustable. The system may be made of a material, such as plastic or metal, that is resistant to environmental factors, as pickleball courts are often exposed to environmental elements, such as sunshine, heat, cold temperature, rain, snow, and the like.

To use the device of the present disclosure, the rack may be mounted or supported on any desired external surface, such as on the fencing surrounding a pickleball court or on the wall of an inside pickleball court, with the channel facing upwards. A plurality of paddle caddies may be placed into the channel with the open ends facing upwards. Users may place their paddles, likely in either groups of 2 or 4, into a caddy, and slide their caddy all the way to one end, such as the left side, of the rack. Subsequent players will place their paddles in a caddy and slide their caddy all the way to the left, behind the first caddy. When it is a group's turn to play, they may remove their paddles from the caddy, move their caddy to the end of the line, and slide the line of caddies to the left, making the second caddy become the first caddy and, thus, updating the queue.

While the above description focuses on use of the device or system in the pickleball realm, it is understood and envisioned that the device or a similar device may be used in any sport that utilizes paddles, rackets, sticks, or the like.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A sliding pickleball paddle queue rack for storing paddles and updating the queue, the sliding pickleball paddle queue rack comprising:

an elongate rack with a channel extending into and along a greatest length thereof; and a plurality of paddle caddies slidably positioned within the channel, each paddle caddy of the plurality of paddle caddies configured to securely accommodate placement of a plurality of paddles therein, wherein:

the plurality of paddle caddies are designed to freely slide along a length of the channel;

each paddle caddy of the plurality of paddle caddies comprises a carriage with a first end, a second end, and an open top, defining a paddle storage area;

each carriage is sized to accommodate placement of a plurality of paddles therein;

each carriage comprises a grouping of a plurality of cylindrical members attached in a line, each cylindrical member being hollow with a closed bottom and sized to accommodate insertion of one paddle handle therein.

2. The sliding pickleball paddle queue rack of claim 1, wherein the elongate rack has a fixed length.

3. The sliding pickleball paddle queue rack of claim 2, wherein:

the elongate rack is an elongate tubular member with a first end and a second end;

a first cap is attached to and closes off the first end; and a second cap is attached to and closes off the second end.

4. The sliding pickleball paddle queue rack of claim 1, wherein the elongate rack has a squared-off U cross-section.

5. The sliding pickleball paddle queue rack of claim 4, wherein the elongate rack has a customizable length.

6. The sliding pickleball paddle queue rack of claim 5, wherein the elongate rack comprises a plurality of rack sections removably engaged to one another.

7. The sliding pickleball paddle queue rack of claim 6, wherein each rack section of the plurality of rack sections comprises:

a base; and two sidewalls extending upward from opposite edges of the base, wherein:

a first end of each rack section has a center tab extending outward from the sidewalls;

a second end of each rack section has a central notch cut therein, the central notch sized to accommodate insertion of a center tab from an adjacent rack section therein; and a fastener attaches the two rack sections through the sidewalls of the first section and the center tab of a second section.

8. The sliding pickleball paddle queue rack of claim 1, wherein the plurality of paddle caddies comprises a member selected from the group consisting of (i) a plurality of four paddle caddies; (ii) a plurality of two paddle caddies; and (iii) a combination of four paddle caddies and two paddle caddies.

9. The sliding pickleball paddle queue rack of claim 1, further comprising a color strip applied to a top edge of each paddle caddy of the plurality of paddle caddies, wherein each paddle caddy has a different colored strip.

10. A sliding pickleball paddle queue rack for storing paddles and updating the queue, the sliding pickleball paddle queue rack comprising:

an elongate rack with a channel extending into and along a greatest length thereof; and a plurality of paddle caddies slidably positioned within the channel, each paddle caddy of the plurality of paddle caddies configured to securely accommodate placement of a plurality of paddles therein, wherein:

the plurality of paddle caddies are each designed to freely slide along a length of the channel;

the elongate rack comprises a plurality of rack sections removably engaged to one another; each rack section of the plurality of rack sections comprising:

a base; and two sidewalls extending upward from opposite edges of the base, a first end of each rack section has a center tab extending outward from the sidewalls;

a second end of each rack section has a central notch cut therein, the central notch sized to accommodate insertion of a center tab from an adjacent rack section therein; and a fastener attaches the two rack sections through the sidewalls of the first section and the center tab of a second section.

* * * * *